United States Patent [19]

Camren

[11] 4,454,778

[45] Jun. 19, 1984

[54] PUMP JACK SYSTEM FOR OIL WELL

[76] Inventor: Virgil Camren, 405 N. 10th St., Parsons, Kans. 67357

[21] Appl. No.: 256,078

[22] Filed: Apr. 21, 1981

[51] Int. Cl.[3] ..... F16B 13/00

[52] U.S. Cl. ..... 74/41; 74/214

[58] Field of Search ..... 74/41, 214, 215; 417/44, 38

[56] References Cited

U.S. PATENT DOCUMENTS

| | | | |
|---|---|---|---|
| 1,758,728 | 5/1930 | Wilkins | 74/41 UX |
| 2,142,552 | 1/1939 | Athy | 74/41 |
| 2,515,360 | 7/1950 | Vail | 74/41 |
| 2,877,652 | 3/1959 | Muschalek | 74/41 |
| 3,006,201 | 10/1961 | Ross | 74/41 |
| 3,215,411 | 11/1965 | Pitts | 74/215 |
| 3,277,730 | 10/1966 | Chastain | 74/41 |
| 3,778,694 | 12/1973 | Hubby | 417/44 |
| 4,194,393 | 3/1980 | Boley | 417/44 |

*Primary Examiner*—William F. Pate, III

*Attorney, Agent, or Firm*—William E. Mouzavires

[57] ABSTRACT

A pump jack system for an oil well comprising a walking beam having one end connected to a vertical pump rod while being pivoted intermediate its ends for rocking movement by means of a single vertical connecting arm driven through an eccentric connection to a cushioned wheel, preferably a pneumatic tire. The latter is driven by a motor through pulley and sprocket members which provide speed reduction to a horizontal drive shaft that engages across the surface of the wheel to drive the same. The other end of the walking beam is provided with weights slidable along the beam into adjusted positions for counterbalancing the forces imposed on the beam through the pump rod. The wheel is also suitably weighted to counterbalance the weight of the connecting arm and its bearing on the wheel. To automatically deenergize the motor when the pump rod is jammed in the well, a limit switch assembly is mounted on the beam adjacent the end at which the pump rod is located. The motor and its drive train to the wheel, are mounted on the same support structure to permit easy removal and replacement as a unit.

13 Claims, 8 Drawing Figures

PUMP JACK SYSTEM FOR OIL WELL

BACKGROUND OF INVENTION

Oil well pump jacks in common use today employ a rocking beam referred to as a "walking beam" for reciprocating a vertical pump rod which of course extends into the well to drive the pump. The walking beam is driven from a motor through a gear box which provides the necessary speed reduction. The gear box drives a pair of vertical arms which are connected to the beam to rock the same upon vertical reciprocation of the arms.

Due to the fact that the oil wells are pumped continuously, shocks emanating from the pump rod in the well and from other parts of the system, are transmitted to the drive system. Over a period of time, the shocks may result in breakdown of the gear box and stoppage of the pumping operation. In addition, the gears become worn and develop slack which causes the pump rod to be jerked at the opposite extremes of its strokes, thus making the pumping operation inefficient while placing unnecessary stresses on the pump and other parts of the system.

In addition to the fact that the pumping operations are continuous, they are also often unattended. Hence, when the pump or its rod becomes jammed in the well, the drive system and motor become susceptible to grinding and wear causing damage to the parts and "burn-out" of the motor.

OBJECTS OF THE PRESENT INVENTION

It is a primary object of the present invention to provide a novel and improved pump jack system for an oil well pump that will eliminate the aforementioned problems and drawbacks of conventional oil well pump jacks in common use today. The pump jack system of the present invention may also be used in water well systems or other deep well operations.

Another object of the present invention is to provide a novel pump jack system for an oil or water well that will uniquely absorb harmful shocks to provide efficient and smooth operation of the system and the associated pump while prolonging their useful life. Included herein is such a pump jack system that will give reliable service over long periods of continued and unattended use.

Another object of the present invention is to provide a well pump jack having a novel drive system that may be driven from a conventional motor and yet will successfully withstand and absorb the shocks emanating from the well without effecting operation of the associated pump or shortening the life of the system.

A further object of the present invention is to provide a novel drive system for a well pump jack that may easily be installed or replaced to change the speed reduction of the system or for other purposes.

A still further object of the present invention is to provide a novel drive system for a well pump jack that is more economical to manufacture, install and replace than conventional gear box systems in present use today. Included herein is such a drive system that eliminates certain parts heretofore required in conventional pump jack systems.

Yet another object of the present invention is to provide a pump jack system for a well pump that will automatically be deenergized when the associated pump or pump rod becomes jammed or obstructed in the well so as to safeguard against damage to the system.

A still further object of the present invention is to provide for a well pump, a jack including a walking beam that is balanced through means of weights that may be easily adjusted and secured along the beam by a single operator.

SUMMARY OF INVENTION

The present invention is embodied in a pump jack including a walking beam which is rocked about a fulcrum by means of a single connecting arm that is eccentrically connected to a cushioned wheel to be vertically reciprocated upon rotation of the wheel. The latter is effected by means of a drive shaft which engages across the surface of the wheel and which is driven by a speed reduction train connected to the output shaft of a motor. The side of the wheel opposite the side to which the connecting arm is connected through a bearing, is provided with a weight for balancing the wheel. In addition, the walking beam is provided with a plurality of dead weights for balancing the walking beam, the weights being mounted for adjustable movement along the beam into the desired position. To protect the motor and other parts of the system when the pump or pump rod becomes jammed in the well, a limit switch is provided on the walking beam for automatically deenergizing the motor.

DRAWINGS

Other objects and advantages of the present invention will become apparent from the following more detailed description taken in conjunction with the attached drawings in which.

DETAILED DESCRIPTION

Figure 1:
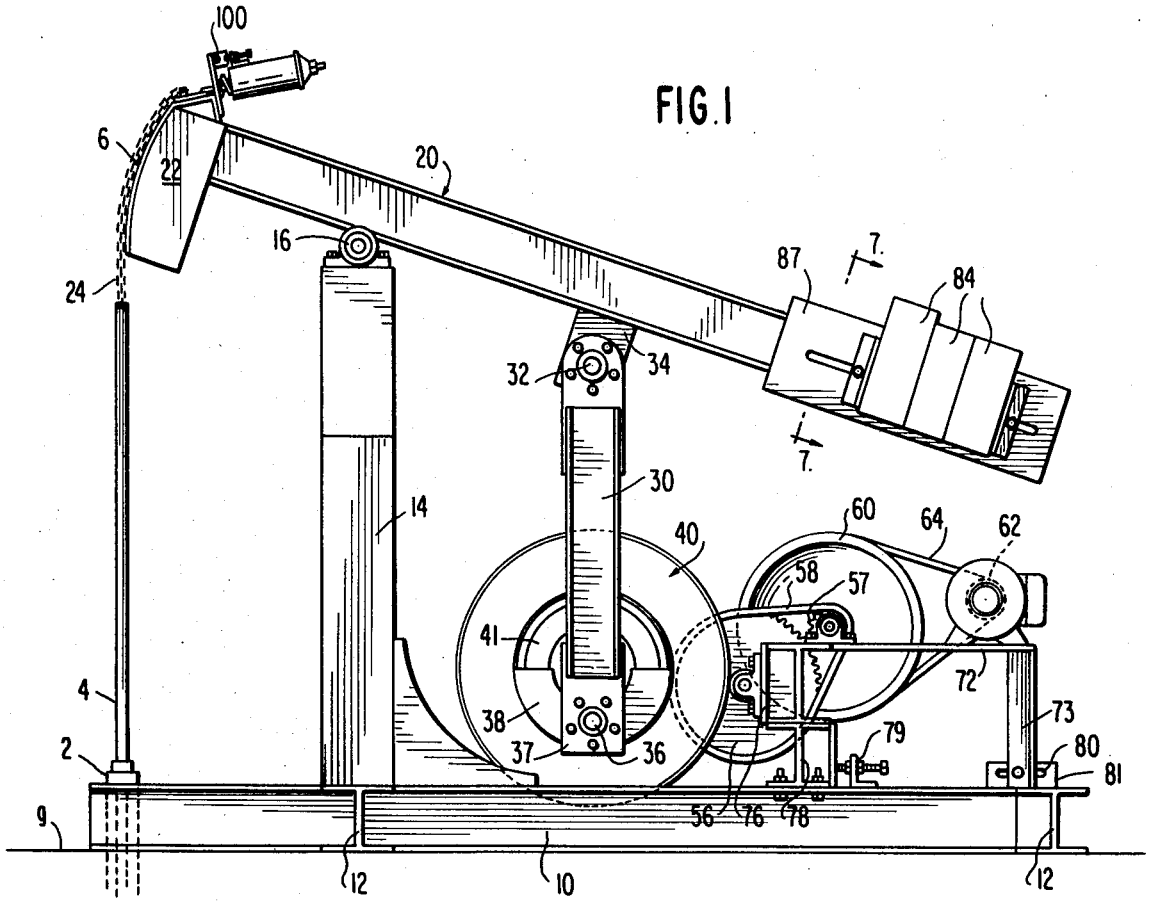
FIG. 1 is an elevational view of a pump jack system embodying the present invention for use in pumping water or oil from an associated well.
Figure 2:
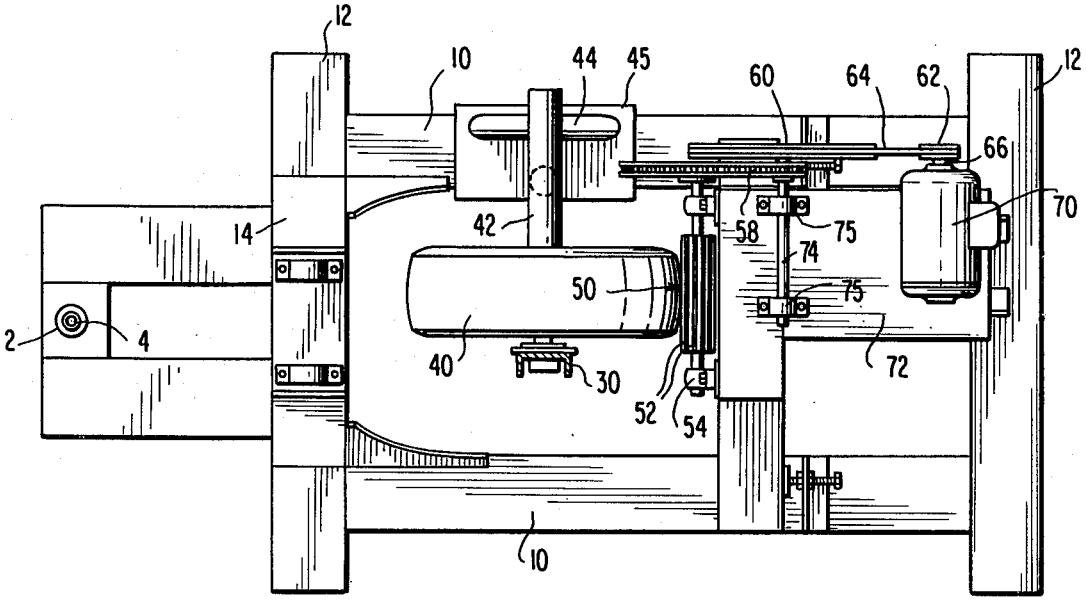
FIG. 2 is an elevational view of the system shown in FIG. 1.

Referring to the drawings and initially to FIGS. 1 and 2, there is shown for illustrative purposes only, a pump jack system constituting a preferred embodiment of the present invention for use with an oil well or a water well (not shown) existing in the ground g. The well has a typical well head designated 2, with a vertical polish rod 4 extending through the well head and below which it is suitably connected to a string of rod for eventual connection to a pump to reciprocate the same in accordance with well-known pumping operations. In the specific embodiment shown, the system includes a base structure comprised of a pair of horizontally extending parallel beams 10 which may rest on the ground surface g and which are joined at opposite end portions thereof by cross beams 12. Upstanding from the base structure is a column 14 which may be made up of any suitable beam structure on the top of which is fixed a fulcrum in the form of any suitable bearing block 16. A walking beam generally designated 20 is fulcrumed on bearing block 16 for pivotal, rocking movement for purposes of reciprocating polish rod 4 and eventually for operating the pump in the well. Walking beam 20 is typically elongated and may be formed by any suitable H-beam or other member which, on one end, includes a head 22 having an outer curved surface 6 about which a connecting member, shown as chains 24, is mounted for attachment to the polish rod 4. Except for the manner in which chains 24 are fixed relative to the head as will be described below, the aforementioned structure is generally well-known in the art and needs no further elaboration.

Actuation of walking beam 20 about fulcrum 16 is achieved in accordance with the present invention by means of a single connecting rod generally designated 30 which may be formed by any suitable beam of sufficient strength. Connecting arm 30 has its upper portion mounted about a suitable spindle bearing 32 which is mounted in a strap 34 fixed to the underside of walking beam 20. Connecting arm 30 is driven in vertical reciprocation in accordance with the present invention by means including a cushioned wheel generally designated 40 which, in the preferred embodiment, is a pneumatic tire made from suitable rubber or rubberlike material. Wheel 40 is journaled for rotation about a horizontal axis provided by a spindle 42 which is mounted on support struts 44 fixed on a base plate 45 which, in turn, rests on one of the beams 10 of the base structure, see also FIG. 4. Motion is transmitted from wheel 40 to the connecting arm 30 by means of a suitable bearing which may be a spindle 36 mounted in a plate 37 which is suitably fixed to connecting arm 30. Spindle 36 is also suitably journaled relative to the hub 41 of the wheel by a mounting plate 38 which receives the spindle and is fixed to the hub 41. On the side of the wheel opposite connecting arm 30, the wheel hub 41 is provided with a suitable weight 39, see FIG. 3, for balancing the forces on the wheel. Spindle 36 is, of course, offset from, or eccentric, to the axis of rotation of wheel 40, the latter axis being through the center of wheel spindle 42. In one preferred embodiment, the offset is about six and one-half inches (6½") where the diameter of the tire is about twenty nine inches (29").

Figure 3:
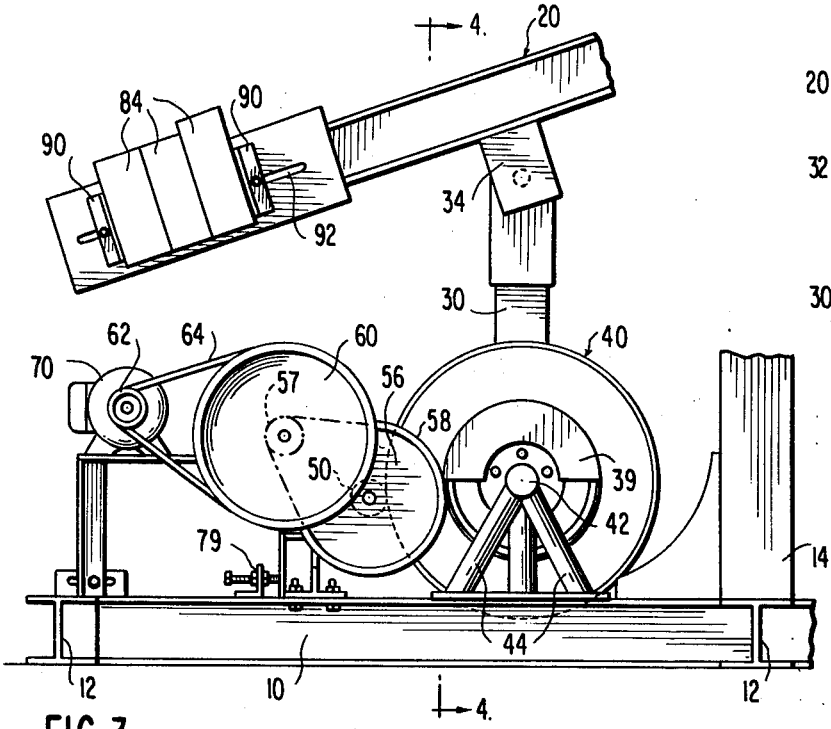
FIG. 3 is an elevational view of a portion of the system shown in FIG. 1 but as seen from the opposite side.
Figure 4:
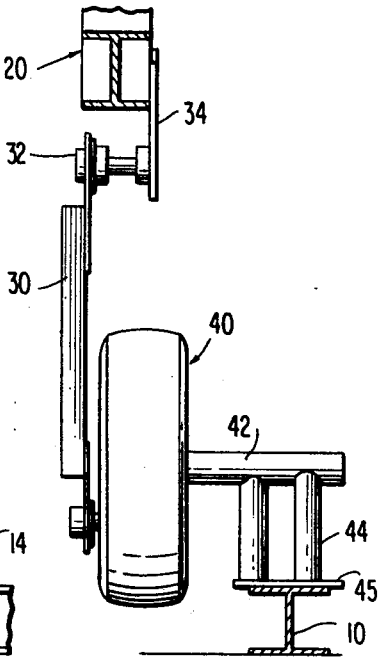
FIG. 4 is a cross-sectional view taken generally along lines 4—4 of FIG. 3.

Wheel 40 is driven in rotation by means of what will be referred to as a drive shaft generally designated 50 (see FIG. 2) which is journaled for rotation about a horizontal axis in bearing blocks 54 so as to engage across the peripheral surface of the wheel 40 as shown in FIGS. 1, 2 and 3. As will be described in more detail below, drive shaft 50 is positioned to engage across the peripheral surface of wheel 40 with sufficient pressure so as to drive the same upon rotation of drive shaft 50. During such rotation, any shocks imparted to or through the walking beam and connecting arm 30 will be uniquely absorbed by wheel 40 due to its flexible and resilient construction which, in the preferred embodiment, is achieved through a pneumatic tire containing a predetermined air pressure for example, fifteen pounds per square inch (15 p.s.i.). The tire may have a diameter of about twenty-nine inches (29") and a width of about six inches (6"). In addition, it is preferred that the surface of drive shaft 50 be provided with longitudinal elongated projections or stringer beads 52 (see FIG. 2) to increase the engagement between drive shaft 50 and wheel 40. However, the surface of drive shaft 40 may be made from any suitable metallic or non-metallic material so as to achieve the proper desired pressure against wheel 40. In one preferred embodiment using the tire described above, the drive shaft 40 has a three inch (3") diameter with one-eighth of an inch (⅛") stringer beads 52.

Drive shaft 50 is rotated in the preferred embodiment by means of a speed reduction train, including a large sprocket 56 which is suitably fixed to one end of drive shaft 50; and a small gear or pinion 57 which is drivingly connected by chain 58 to the large sprocket 56. Pinion 57 is, in turn, fixed on a horizontal shaft 74 (see FIG. 2) which is journaled in suitable bearing blocks 75. Beyond the location of pinion 57, pinion shaft 74 is fixed to a large pulley 60 which is driven by a small pulley 62 through a belt 64. Small pulley 62 is fixed on the output shaft 66 of a suitable motor, for example, a one-half (½) horsepower 750 rpm electric motor.

In one preferred embodiment, large pulley 60 has a sixteen inch (16") diameter, small sprocket 57 has fourteen (14) teeth and large sprocket 56 has sixty (60) teeth. In this way, a speed reduction of about 38 to 1 may be achieved without slippage and without having to utilize a gear box as has been commonly used over the years in conventional pump jacks. Moreover, the cushioned wheel 40 absorbs the harmful shocks of the system providing efficient pumping while protecting the pump as well as the speed reducing train and the other parts. Furthermore, as will be described below, the speed reducing train, may, in addition to the wheel 40, be easily installed and replaced to change the speed reduction in a range of say, 36 to 1 to 41 to 1 to provide a pump stroke in a range of 6 to 16 strokes per minute.

The motor 70, together with its pulley and sprocket drive train, may be mounted on the basic support beams 10 as a unit so that it may be easily adjusted into place or removed as a unit. To this end and referring to FIGS. 1 and 2, a table support structure is utilized including a horizontal top 72 on which the motor 70 is mounted. The table includes vertical leg structures 73 at one end which are bolted relative to the beams 10 by means of brackets 81 having slots 80 allowing adjustment of the support table. Also on table top 72 are mounted journal blocks 75 of pinion shaft 74. At the end of the table opposite legs 73, the drive shaft 50 is mounted through its journal blocks 54 which are fixed to the table at that area.

Referring to FIG. 1, the bottom of the support table is also fixed to the base beams 10 by means of a cross beam 78 which is bolted to the former in a preselected adjusted position. To this end, adjusting bolt assemblies generally designated 79, are utilized for purposes of adjusting in increments the position of the support table along the base support beams 10. It will therefore be seen that the entire drive system may be removed as a unit and replaced to change the speed reduction or to replace parts. Also, the adjustment is used to apply the proper pressure on wheel 40 through drive shaft 50.

Figure 7:
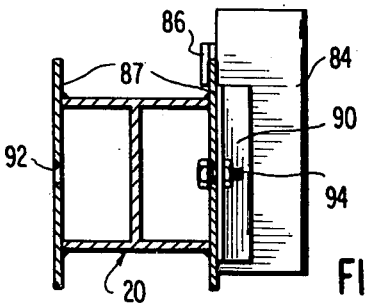
FIG. 7 is a cross-sectional view taken generally along lines 7—7 of FIG. 1.
Figure 8:
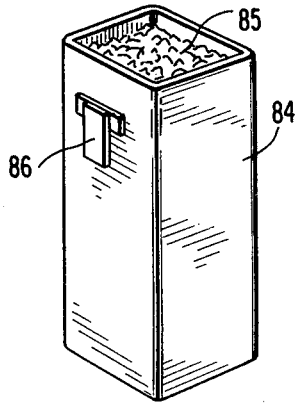
FIG. 8 is a perspective view of one of the balancing weights that may be employed on the walking beam included in the system.

Referring now to FIGS. 1, 3, 7 and 8, walking beam 20, at its end portion opposite its head portion 22, is provided with a plurality of weights 84 that may be placed into desired positions along the beam 20 to balance the walking beam. The latter is achieved by means of novel structure which, in the shown embodiment, includes a plurality of weight-mounting plates 87 fixed, such as by welding to opposite sides of the walking beam 20, as best shown in FIG. 7. Mounting plates 87 project above the upper surfaces of walking beam 20 where they are free to receive mounting brackets 86 which are fixed to the inner sides of the weights 84 as best shown in FIG. 8. The mounting brackets 86 project from the surface of the weights 84 so that the brackets 86 may be received over the marginal areas of the mounting plates 87, as best shown in FIG. 7. This allows the weights to be slid in increments by a single operator along the mounting plates 87 into the desired position along the walking beam 20 to achieve the necessary balance.

Once the weights 84 are adjusted into the proper position, they are secured therein by means of retaining members 90 which are mounted by means of bolt and nut assemblies 94 to plates 87 with the bolts passing through elongated apertures 92 provided in the mounting plates 87, as best shown in FIGS. 3 and 7. Securement of the nut and bolt assemblies 94 against the plates 87 on opposite ends of the weights 84, as shown in FIG. 3, will retain the weights 84 in the proper desired position. If it is desired to move the weights or remove any of the weights, the nut and bolt assemblies 94 are loosened to allow the retaining members 90 to be removed from engagement with the weights 84. In the preferred embodiment shown, the retaining members 90 are right-angle channel members having one leg which is engageable with the sides of the weights and another leg which is engageable against the mounting plates 87 of the walking beam 20.

Figure 5:
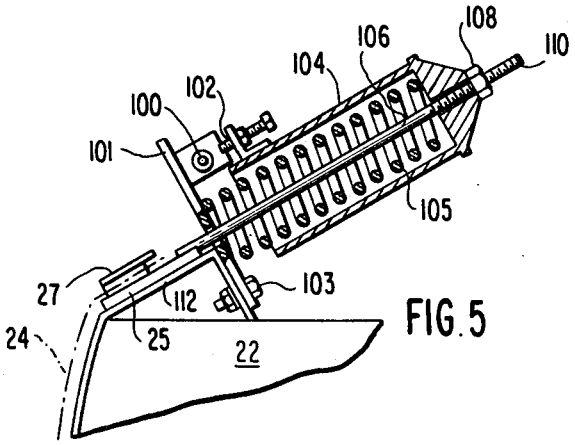
FIG. 5 is a cross-sectional view through a limit switch assembly mounted at the head of a walking beam included in the system.

Referring to FIG. 5, in accordance with another feature of the present invention, a limit switch assembly is provided to automatically deenergize motor 70 in the event the pump or pump rod becomes jammed in the well. The limit switch assembly includes a limit switch 100 which is fixed relative to the head 22 of the walking beam by means of an inverted L-shaped bracket 112 fixed to the walking beam, and a mounting plate 101 fixed to bracket 112 through a nut and bolt assembly generally designated 103. Limit switch 100 is mounted on mounting plate 101 to be engageable by an actuator 102 which is mounted on a cylinder 104 which, in turn, is mounted about an internal rod 106. Rod 106 is fixed at one end to a chain mounting plate 25 that rests on bracket 112 and has an upstanding hook portion 27 for anchoring the connecting chains 24. Within cylinder 24 about rod 106 is a compression coil spring 105 which urges the cylinder 104 against an adjustable stop in the form of a nut 108 received on threads 110 of rod 106. Spring 105 is anchored at its opposite end against mounting plate 101. Since rod 106 is fixed to chain mounting plate 112, the spring 105 imposes an upward force on the chains 24. Spring 105 is designed so that this force is sufficient to properly hold the chains 24 relative to the head 22 of the walking beam during normal operation of the system. However, when a jam occurs in the well and the chains 24 are sufficiently tensioned to overcome the force of spring 105, the cylinder 104 will be moved downwardly to open the limit switch as will now be described.

Figure 6:
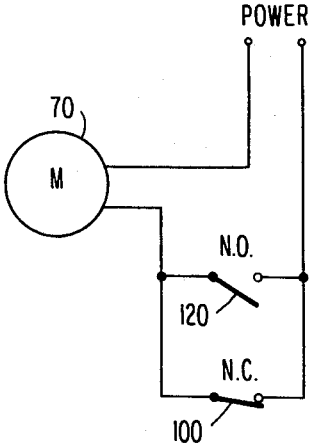
FIG. 6 is a diagram of a circuit for controlling a motor included in the system.

Referring to FIG. 6, the limit switch 100 is normally maintained in the closed position during operation of the pump jack system and the associated pump. However, when an obstruction or jam occurs in the well obstructing movement of the walking beam or rod 4, spring 105 will be compressed as described above and the actuator 102 will open the limit switch 100 to automatically deenergize the motor 70 to prevent damage. The circuit is also provided with another switch 120 which is normally maintained in the open position. However, after the circuit is deenergized by the opening of limit switch 100 in the above manner, the operator may close the switch 120 to energize the motor to test the system. When the operator finds the system is jammed in the well, he opens switch 120 and removes the obstruction. After the jam in the well is removed, the operator may then reset the limit switch 100 to closed position to commence the pumping operation.

It will thus be seen from the above that the present invention not only solves the aforementioned problems long attendant conventional oil well pump jack systems, but does so in a manner that is less expensive and more versatile than the conventional drive systems of the prior oil well pump jacks. The result is a smooth running jack system that will withstand the shocks of operation over long periods of continuous, efficient and unattended use. Moreover, the present invention requires only a single connecting arm for rocking the walking beam, and further provides a safety feature for automatically stopping the system should a jam occur in the well. Additionally, the present invention highly facilitates the movement of the balancing weights along the walking beam into the desired position requiring but a single operator to effect such in an accurate manner.

What is claimed is:

1. A pump jack system for an oil well comprising in combination, a walking beam adapted to be connected at one end portion thereof to a vertical pump rod and pivotable about a horizontal axis at a fulcrum intermediate its ends for reciprocating the pump rod, an arm pivotally connected to the beam intermediate its ends for rocking the beam about said horizontal axis, a pneumatic wheel mounted for rotation below the beam about a fixed horizontal wheel axis, said arm being pivotally connected to the wheel at a location on one side of the wheel offset from the wheel axis to drive the arm upon rotation of the wheel, a drive shaft mounted for rotation about a fixed horizontal drive shaft axis, said drive shaft extending transversely across said wheel in frictional engagement therewith for rotating the wheel, a motor, and speed reduction means operatively connected between the motor and the drive shaft for driving the drive shaft, said speed reduction means including a first motion transmitting wheel fixed to said drive shaft for rotating the same, a second motion transmitting wheel having a smaller diameter than the first wheel and being operatively connected to said first wheel for driving the same, said second wheel being operatively connected to said motor to be driven thereby.

2. The pump jack system defined in claim 1 including a balancing weight fixed to the wheel at a location on the other side thereof opposite the location of the arm for balancing the wheel.

3. The pump jack system defined in claim 1 further including switch means on the walking beam for deenergizing the motor when the associated pump rod is jammed in an associated well.

4. The pump jack system defined in claim 1 wherein the drive shaft has a plurality of projections thereon spaced circumferentially about the drive shaft for increasing engagement with the wheel.

5. The pump jack system defined in claim 1 wherein there is but a single arm connecting the walking beam to the wheel.

6. The pump jack system defined in claim 1 further including at least one beam weight mounted on the walking beam for sliding movement along the walking beam into a desired position for balancing the rocker arm, and a pair of retaining members mounted to the walking beam on opposite sides of the beam weight and in engagement therewith for retaining the beam weight in position against movement.

7. The pump jack system defined in claim 6 including a weight mounting plate projecting above the walking beam, and said beam weight includes a bracket received over an upper edge of the mounting plate.

8. The pump jack system defined in claim 1 wherein said drive shaft, speed reduction means and said motor are mounted as a unit relative to the wheel.

9. The pump jack system defined in claim 1 wherein said motor has about one-half (½) horsepower, said pneumatic wheel is a tire having about 15 p.s.i. air pressure, and the speed reduction means provides speed reduction in a range of 36 to 1 to 41 to 1.

10. In a pump jack system for an oil well including a vertical pump rod adapted to be connected to a pump in a well, a walking beam fulcrumed intermediate its ends for movement about a horizontal axis, drive means including a motor for oscillating the walking beam about said axis, a connecting member interconnecting the pump rod and one end portion of the walking beam; the improvement comprising means including a spring mounting the connecting member on said walking beam and permitting the connecting member to move relative to the walking beam when a predetermined amount of tension is applied to the connecting member, a switch means fixed relative to the walking beam for controlling energization of the motor, and a switch actuator movable in response to movement of the spring for actuating the switch means to open position for deenergizing said motor when the connecting member is subject to a predetermined amount of tension.

11. The improvement defined in claim 10 further including a second switch means for controlling energization of the motor independently of the first switch means.

12. In a pump jack system for an oil well including a walking beam fulcrumed intermediate its ends for movement about a horizontal axis, drive means for oscillating the walking beam about said axis, a connecting means for connecting one end portion of the walking beam to a pump in an associated well, the improvement comprising; a plurality of balancing weights each having a hanging bracket on one side for mounting the weights on the walking beam with the weights in side-by-side relationship, a pair of retaining members mounted on one side of said walking beam on opposite ends of said weights for movement into and out of engagement with the weights, and means for releasably securing the retaining members against the walking beam and opposite ends of said weights for securing the weights against movement, and wherein said walking beam has an upper edge portion projecting above a main body portion of the walking beam, and the hanging bracket of each weight is received over said upper edge portion of the walking beam, and wherein there is further included a mounting plate fixed to said one side of the walking beam and projecting above the main body of the walking beam and providing said upper edge portions thereof, said mounting plate having an elongated slot therein extending in the longitudinal direction of the walking beam, and wherein said means for releasably securing said retaining members includes bolt received through said retaining members and said slot in said mounting plate.

13. A pump jack system for an oil well comprising in combination, a walking beam adapted to be connected at one end portion thereof to a vertical pump rod and pivotable about a horizontal axis at a fulcrum intermediate its ends for reciprocating the pump rod, an arm pivotally connected to the beam intermediate its ends for rocking the beam about said horizontal axis, a pneumatic wheel mounted for rotation below the beam about a fixed horizontal wheel axis, said arm being pivotally connected to the wheel at a location on one side of the wheel offset from the wheel axis to drive the arm upon rotation of the wheel, a drive shaft mounted for rotation about a fixed horizontal drive shaft axis, said drive shaft extending transversely across said wheel in frictional engagement therewith for rotating the wheel, a motor, and speed reduction means operatively connected between the motor and the drive shaft for driving the drive shaft, at least one beam weight mounted on the walking beam for sliding movement along the walking beam into a desired position for balancing the rocker arm, and a pair of retaining members mounted to the walking beam on opposite sides of the beam weight and in engagement therewith for retaining the beam weight in position against movement, a weight mounting plate projecting above the walking beam, and said beam weight includes a bracket received over an upper edge of the mounting plate, and wherein said weight mounting plate has an elongated slot therein, said retaining members are movable along said slot into adjusted positions on opposite sides of the beam weight and wherein there is further included means for releasably securing the retaining members relative to the weight mounting plate.

* * * * *